United States Patent [19]

Oberth et al.

[11] 4,270,562

[45] Jun. 2, 1981

[54] FLUID SEQUENCE BYPASS APPARATUS

[75] Inventors: Hans G. Oberth; Gerhard A. Aminger, both of Graz, Austria

[73] Assignee: Caterpillar Tractor Co., Peoria, Ill.

[21] Appl. No.: 93,076

[22] PCT Filed: Sep. 28, 1979

[86] PCT No.: PCT/US79/00799

§ 371 Date: Sep. 28, 1979

§ 102(e) Date: Sep. 28, 1979

[87] PCT Pub. No.: WO81/00881

PCT Pub. Date: Apr. 2, 1981

[51] Int. Cl.[3] ..... F01P 7/14; F01M 5/00; F16N 13/22

[52] U.S. Cl. ..... 137/115; 123/41.35; 123/196 AB; 137/118; 184/6.22; 184/104 B

[58] Field of Search ..... 123/41.08, 41.33, 41.35, 123/196 R, 196 A, 196 AB, 196 M; 137/115, 118; 184/6.22, 6.24, 104 B

[56] References Cited

U.S. PATENT DOCUMENTS

| | | | |
|---|---|---|---|
| 2,500,627 | 3/1950 | Chinn | 137/118 |
| 3,057,436 | 10/1962 | Jacobson | 123/196 A UX |
| 3,065,743 | 11/1962 | Brehm | 123/41.35 X |
| 3,090,365 | 5/1963 | Constantino | 184/6.22 |
| 3,485,324 | 12/1969 | Novak | 123/196 R X |
| 3,486,582 | 12/1969 | Carter | 123/196 R X |
| 3,943,909 | 3/1976 | Palmer | 123/196 AB |
| 4,058,981 | 11/1977 | Henson | 60/605 |
| 4,114,571 | 9/1978 | Ruf | 123/196 AB X |
| 4,126,997 | 11/1978 | Henson | 60/605 |
| 4,204,487 | 5/1980 | Jones | 123/196 AB X |

FOREIGN PATENT DOCUMENTS

| | | | |
|---|---|---|---|
| 558700 | 3/1957 | Italy | 137/118 |

*Primary Examiner*—Robert G. Nilson
*Attorney, Agent, or Firm*—Phillips, Moore, Weissenberger, Lempio & Majestic

[57] ABSTRACT

In some piston engines a pressurized fluid which is delivered to a main receptor (16) is also delivered to a secondary receptor (18) from which it is directed to cool the pistons. During engine startup and low idle operation such cooling is unnecessary, and further, it is desirable to provide as much fluid flow as possible to the main receptor (16), which is generally the main lubricating manifold (16) of the engine. Herein, delivery of the pressurized fluid to the secondary receptor (18) is prevented until the fluid pressure in the main receptor (16) reaches an initiating value (A). The main receptor (16) thus receives added fluid flow at startup and during low idle operation, while adequate piston cooling is provided at normal operating speeds.

5 Claims, 5 Drawing Figures

FLUID SEQUENCE BYPASS APPARATUS

TECHNICAL FIELD

This invention relates to a fluid sequencing bypass valve for directing pressurized fluid to a secondary manifold only when the pressure in a primary manifold is of a sufficient value, and for bypassing pressurized fluid to a sump when the pressure in the main manifold reaches a selected maximum value.

BACKGROUND ART

In relatively large engines, it is desirable to cool the pistons by impelling jets of lubricating oil onto their surfaces. Generally, the oil is delivered from a secondary manifold to the jets. The secondary manifold is directly connected to the main manifold, or to the line which supplies pressurized fluid thereto.

During engine startup and during low idle running, it is important that the main lubricating manifold receive as much fluid flow as possible, and at a reasonably high pressure, so that this fluid can be delivered to the bearings of the engine which rest against the crankshaft and to other bearing surfaces. However, when the prior art structure is used, wherein the secondary manifold is directly connected to the main manifold, some of the fluid flow is delivered to the jets which cool the pistons. Such cooling of pistons is, however, not necessary during startup and at low idle running of the engine, since the pistons are not being greatly heated under these relatively low load conditions. Thus, the oil delivered to the secondary manifold and therefrom to the cooling jets is basically wasted and, worse, serves to reduce the amount of oil delivered to the crankshaft bearings and to other surfaces which require lubrication.

Generally, the pump which is pumping the lubricating fluid to the manifolds has a bypass valve built directly into it or located closely downstream therefrom. Since the filters in such a system are generally downwstream from the bypass valve, a significant pressure drop can take place within the filters, particularly as they become clogged. Thus, in the typical prior art method of controlling pressure by having a bypass valve built directly into or closely adjacent the pump, the pressure actually delivered to the main manifold, and a secondary manifold when present, can be considerably lower than that set at the bypass valve. It is clear that this is undesirable, since lubricating fluid may be supplied at too low a pressure to adequately carry out lubrication of the crankshaft bearings, etc., and provide such jet action as is required to cool the pistons of relatively large engines.

DISCLOSURE OF INVENTION

The present invention is directed to overcoming one or more of the problems as set forth above.

In accordance with the present invention, an improvement is provided in a system having a pressurized fluid source and main and secondary receptors (generally manifolds) to which the source provides pressurized fluid. The improvement comprises means for preventing delivery of the fluid to the secondary receptor until a pressure of the fluid in the main receptor reaches an initiating value.

In accordance with the present invention, the pressure in the main receptor must reach an initiating value for initiating flow to the secondary manifold. In this manner, during start up and at low idle the main receptor receives all of the flow of filtered oil from the pump. On the other hand, when the engine begins running at higher speeds, and in particular when the pressure in the main receptor reaches the initiating value, the secondary receptor is connected to the flow so that piston cooling jets can operate which receive their flow from the secondary receptor and deliver it to cool the pistons with filtered oil. Filtered oil is necessary because the piston cooling oil also lubricates the piston pin. Also, in a preferred embodiment of the invention the improvement also comprises a bypass valve mode which opens when the pressure in the main receptor downstream of the filters reaches a selected bypass value, so that unfiltered oil can be bypassed. Therefore, smaller oil filters can be used. Thereby, the bypass valve operates only when the pressure actually delivered to the main and secondary receptors is at a sufficient level.

BEST MODE FOR CARRYING OUT THE INVENTION

Figure 1:
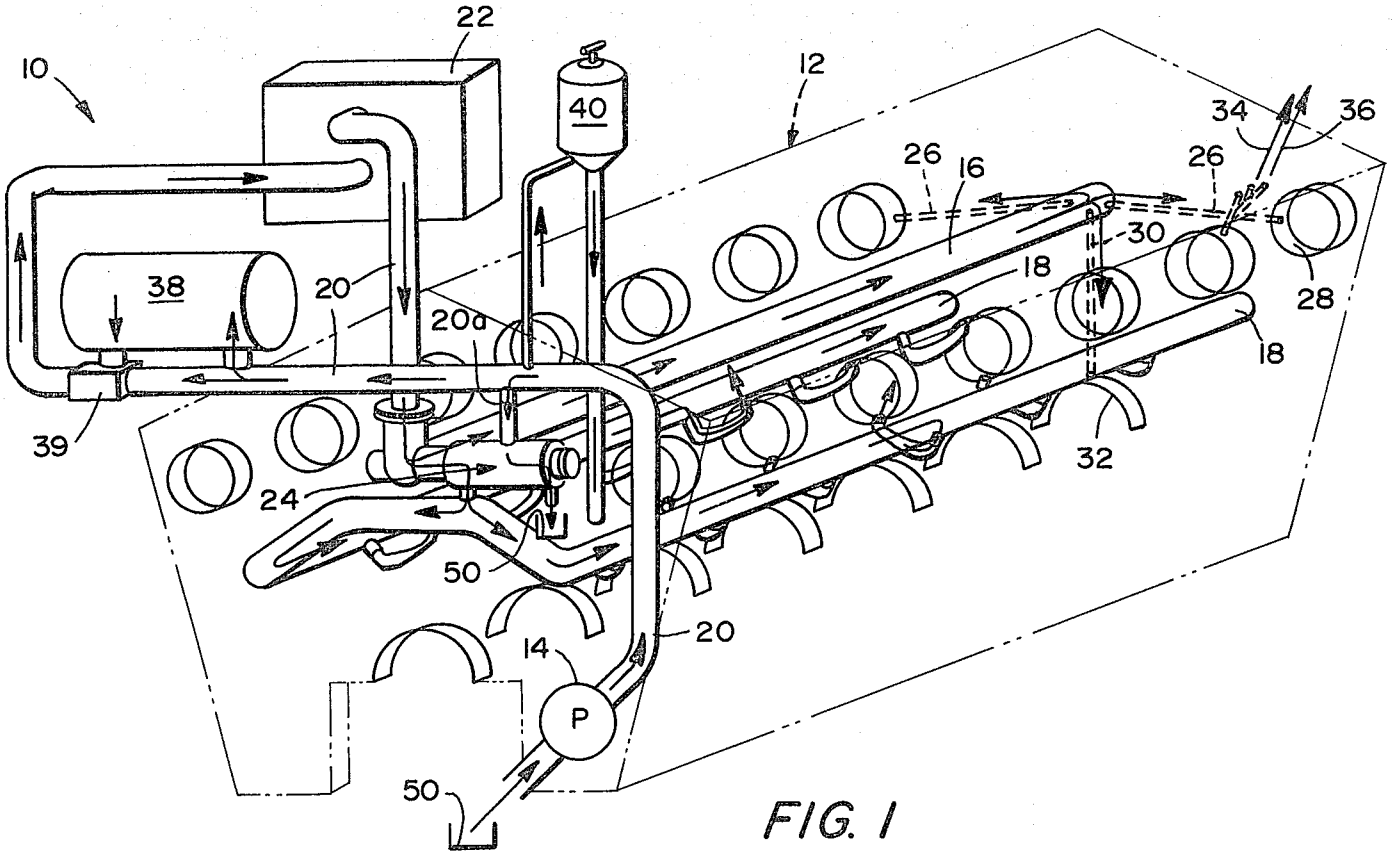
FIG. 1 illustrates, in a partially perspective partially schematic view, an engine utilizing an embodiment in accordance with the present invention.

Adverting to FIG. 1, there is illustrated therein a system 10 for flowing pressurized fluid to an engine 12. The system 10 includes a pressurized fluid source 14, a main receptor (manifold) 16, and a pair (at least one) of secondary receptors (manifolds) 18. Fluid is supplied from the pump 14 via a conduit 20 and filtering means 22 to a fluid sequencing valve 24 in accordance with an embodiment of the invention, from which it passes to the main manifold 16 and the secondary manifold 18. Fluid from the main manifold 16 is delivered as via a plurality of passages 26 (two shown) to various camshaft bearings 28, via a plurality of passages 30 (one shown) to crankshaft bearings 32, as indicated by an arrow 34 to the engine rocker arm and valve mechanism, and as indicated by an arrow 36 to a lifter guide. An oil cooler 38 is generally present for cooling the oil as it passes via the conduit 20 and a thermostatic valve 39. A conventional centrifugal oil filter 40 may also be present.

The fluid sequencing valve 24 serves as means for preventing delivery of the fluid from the conduit 20 to the secondary manifold 18 until a pressure of the fluid in the main manifold 16 reaches an initiating value. Such will be particularly apparent by reference to FIGS. 2–4 and the discussion which follows.

Figure 2:
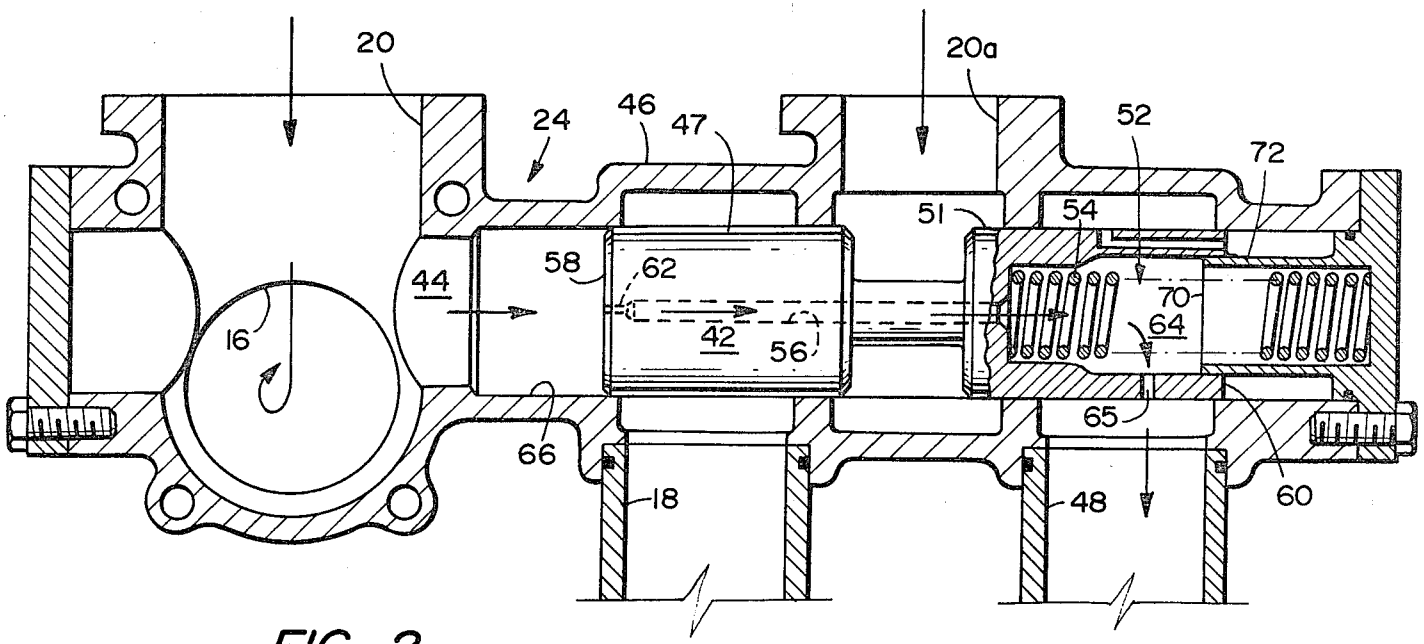
FIG. 2 illustrates in side section view, an embodiment of the improvement in accordance with the present invention in a first mode of operation.

Briefly, the fluid sequencing valve 24 has a first position as illustrated in FIG. 2 which blocks delivery of the pressurized fluid from the conduit 20 to the secondary manifold 18. As will be seen in FIG. 2, a piston 42 reciprocally fits within a bore 44 in a body 46. The piston 42, as seen in FIG. 2, has a land 47 positioned so as to block off flow to the secondary manifold 18. On the other hand, it is seen that flow to the main manifold 16 is not in any way obstructed. Basically, the piston 42 is shown in its first position in the bore 44, said first position comprising a position blocking off the secondary manifold 18.

Figure 3:
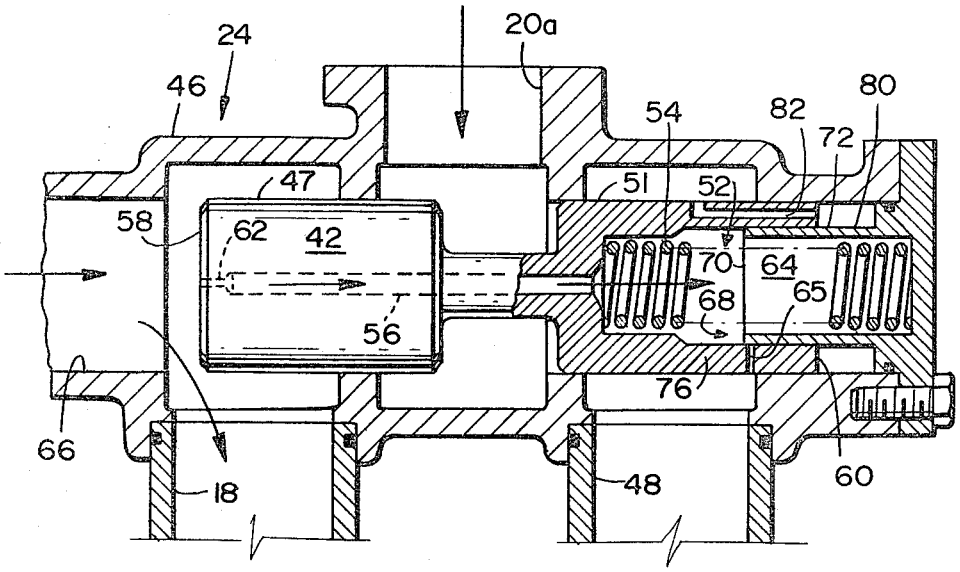
FIG. 3 illustrates in reduced sized, a view similar to FIG. 2 but with the embodiment in a second mode of operation.

Referring to FIG. 3, it will be seen that the piston 42 is in a second position within the bore 44, namely a position wherein flow can occur from the conduit 20 to the secondary manifold 18.

Figure 4:
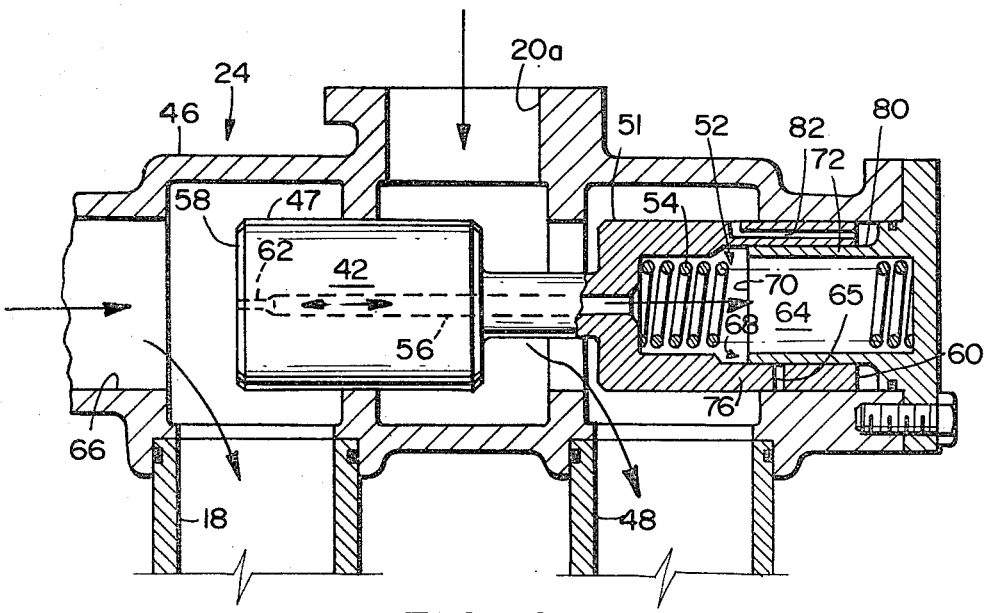
FIG. 4 illustrates a view similar to that of FIGS. 2 and 3, but with the embodiment in yet a third mode of operation.

Referring to FIG. 4, it will be seen that the piston 42 is shown therein in a third position within the bore 44, namely a position which connects a bypass conduit 20*a* (from conduit 20 upstream of filtering means 22) to a sump conduit 48 which leads off to a sump 50 (FIG. 1). Flow proceeds past a land 51 on the piston 42, as illustrated.

Biasing means 52, in the embodiment illustrated a spring 54 acts to motivate the piston 42 towards the first position thereof in the bore 44. Fluid from the first manifold 16 is delivered via a tunnel 56 through the piston 42 from a first end 58 thereof to a second end 60 thereof. A restricted orifice 62 is at the start of the tunnel 56 and serves to provide a lowered pressure in a spring chamber 64 which extends into the piston second end 60 in other modes of operation. An exit orifice 65 communicates the fluid exiting the tunnel 56 with the sump 50. The exit orifice 65 is so dimensioned in comparison to the restricted orifice 62 whereby the spring chamber 64 is either not pressurized, or pressurized to a selected extent, so long as the exit orifice 65 is open. The force of the spring 54, thus serves as the biasing means 52, with the pressure in the spring chamber 64 being substantially zero, or a selected value below the pressure in the first manifold 16 due to the path via exit orifice 65 and sump conduit 48 to the sump 50.

Means, in the embodiment illustrated a portion 66 of the bore 44 which serves to communicate the fluid pressure within the main manifold 16 with the first end 58 of the piston 42, serves for motivating the piston 42 in opposition to the biasing means 52 and into the second position illustrated in FIG. 3, responsive to the pressure in the main manifold 16 reaching an initiating value which corresponds to a sufficient value to move the piston 42 rightwardly so as to open flow between the bore 44 and the secondary manifold 18. It is clear that the piston 42, or more particularly the land 47, then serves as means for blocking delivery of the pressurized fluid to the secondary manifold 18 when the piston 42 is in its first position and for allowing such delivery responsive to the piston 42 being in its second position.

Additional biasing means 68 serves, in addition to biasing means 52, for biasing the piston away from a third position thereof shown in FIG. 4 and towards the second position thereof shown in FIG. 3. In particular, the additional biasing means 68 includes an end 70 of a sleeve 72 which serves for blocking off the exit orifice 65 as the piston 42 moves from the second position (FIG. 3) towards the third position (FIG. 4). The sleeve 72 extends from the body 46 into mating relation within the piston 42. As the piston 42 moves rightwardly from the position shown in FIG. 2 to that shown in FIG. 3, the exit orifice 65, which is through a sidewall 76 which defines the spring chamber 64, is blocked off (as in FIG. 3) by the end 70 of the sleeve 72. Thus, the additional biasing means 68, includes the pressure in spring chamber 64 acting against a smaller area (the cross-sectional area of the spring chamber 64) than the area of the first end 58 of the piston 42. After the exit orifice 65 is closed, and as the piston 42 continues to move rightwardly, reverse flow occurs in the tunnel 56. Also, some flow can occur about the diametrical clearance between the sidewall 76 of the chamber 64 and an exterior 80 of the sleeve 72. Mainly however, lubrication is all that occurs thereat. A calibrated passage 82 serves to allow fluid trapped between the second end 60 of the piston 42, the body 46, and the sleeve 72 to escape to the sump conduit 48 and thence to the sump 50. The diameter of the passage 82 is so small, that a damping effect of the piston 42 movement occurs due to the trapped oil. This eliminates, or at least acts to limit, flutter of the piston 42. It is clear that additional resistance to movement of the piston 42 results between the position shown in FIG. 3 and that shown in FIG. 4.

It will be noted that even when unfiltered fluid is being delivered from the branch conduit 20*a* to the sump conduit 48 as in FIG. 4, filtered pressurized fluid is still being delivered to the secondary manifold 18.

Figure 5:
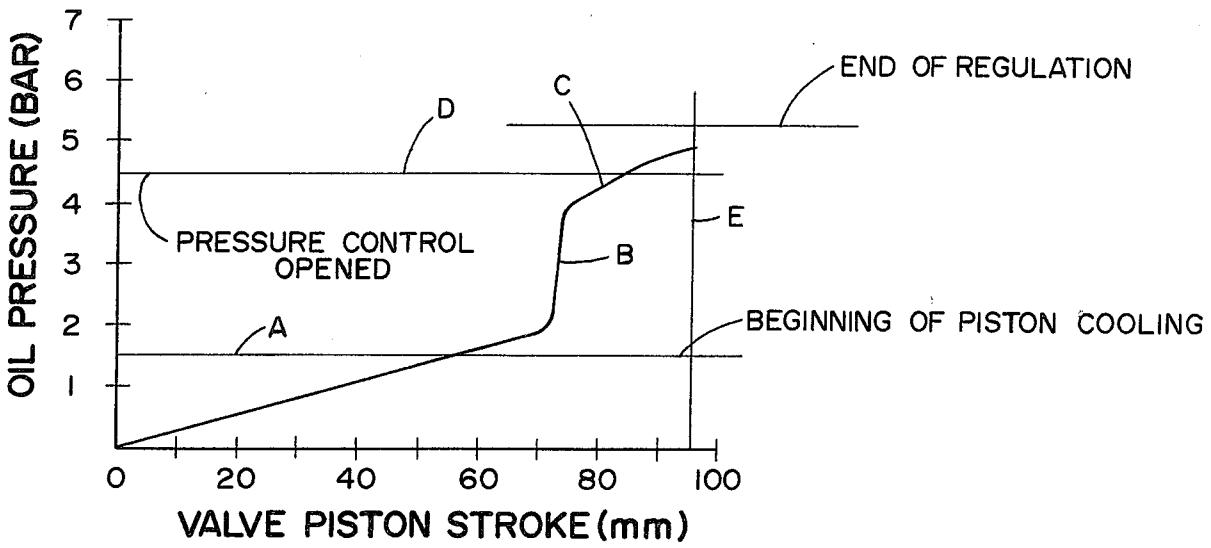
FIG. 5 illustrates, graphically, the operation of an embodiment in accordance with the present invention.

Referring now to FIG. 5, one will see that as the oil pressure rises, for example, on engine start up, the piston 42 moves rightwardly and pressure is delivered soley to the main manifold 16. Once the piston 42 has moved a sufficient distance rightwardly, the secondary manifold 18 starts receiving pressurized fluid for use in cooling the engine pistons, or the like. This corresponds to the pressure line marked A in FIG. 5. During this period, the pressure in the main manifold 16 acts only against the force of the spring 54 since the spring chamber 64 is relieved by the exit orifice 65. As the exit orifice 65 closes, the oil pressure rises rapidly for very slight movement of the piston 42 as pressure in the spring chamber 64 builds up, as shown in the area marked B in FIG. 5. This corresponds to the situation shown in FIG. 3. The region of the curve marked C in FIG. 5 corresponds to movement from the configuration shown in FIG. 3 to that shown in FIG. 4. In the region C, the pressure in the spring chamber 64 is not relieved. The bypass from the branch conduit 20*a* to the sump 50 opens at a pressure level indicated by the line D in FIG. 5. The line indicated at E in FIG. 5 corresponds to maximum rightward movement of the piston 42. It should be noted that the regulation of the pressure delivered to the main manifold 16 and the secondary manifold 18 is determined by the pressure actually delivered thereat, since the valve 24 is downstream of the filters 22.

INDUSTRIAL APPLICABILITY

The aforementioned improvement is particularly useful in large diesel engine systems wherein it is necessary to utilize cooling jets to spray lubricating oil onto the pistons to cool them. The main manifold 16 receives pressurized fluid at all levels of engine operation, while the secondary manifold 18 receives such fluid only when the engine 12 is operating at a sufficient rate so that the pump 14 is producing fluid above an initiation pressure, A. Thus, the camshaft bearings 32, the crankshaft bearings 28, and the like, are properly lubricated even at start up and low idle operation, since none of the pump flow and pressure is diverted at that time to the secondary manifold 18, where it is not then needed. Further, the valve 24 provides a bypass to the sump 50 substantially right at the main manifold 16, and certainly downstream of the filters 22 and cooler 38, so that smaller size filters and coolers can be used. This assures that any reasonably small pressure loss which may take place in the filters 22 does not in any way effect the regulation of the operating pressure at the main manifold 16 and the secondary manifold 18.

Other aspects, objectives, and advantages of this invention can be obtained from a study of the drawings, the disclosure and the appended claims.

We claim:

1. In a system (10) having a pressurized fuel source (14), a sump (50), and a main (16) and at least one secondary (18) receptor to which pressurized fluid is supplied from said source (14), the improvement comprising:

a body (46) having a bore (44) therein;

a piston (42) reciprocally mounted in said bore (44), said piston (42) having a first end (58), a second end (60) and a tunnel (56) therethrough from said first end (58) to said second end (60);

biasing means (52) for biasing said piston (42) into a first position in said bore (44), said biasing means (52) including a spring (54) acting to motivate said piston (42) towards said first position in said bore (44) and a restricted orifice (62) for communicating the fluid via said tunnel (56) to said sump (50) via an exit orifice (65);

means (66) for motivating said piston (42) in opposition to said biasing means (52) and into a second position in said bore (44) in response to a pressure in said main receptor (16) reaching an initiating value (A), said motivating means (66) motivating said piston (42) into a third position in response to said pressure in said main receptor (16) reaching a selected value (D) above said initiating value (A);

means (47) for blocking delivery of said pressurized fluid to said secondary receptor (18) in response to said piston (42) being in said first position and for allowing said delivery in response to said piston (42) being in said second position, said delivery blocking and allowing means (47) allowing delivery of said pressurized fluid to said secondary receptor (18) in response to said piston (42) being in said third position;

means (20*a*) for communicating fluid flow from said source (14) to said body (46);

means (51) for passing said fluid flow through said body (46) to said sump (50) in response to said piston (42) being in said third position and for not passing said fluid to said sump (50) in response to said piston (42) being in said first and second positions; and additional biasing means (68), additive to said biasing means (52), for blocking said exit orifice (65) as said piston (42) moves from said second position towards said third position.

2. The improvement as in claim 1 having means (22) for filtering said fluid intermediate said source (14) and said main receptor (16), and wherein said bore (44) is downstream of said filtering means (22).

3. The improvement as in claim 1, including:

a spring chamber (64) extending into said piston (42) second end (60), a sleeve (72) extending from said body (46) into mating relation with said piston (42), said spring (54) acting between said spring chamber (64) and said sleeve (72), said orifice (65) being through a sidewall (76) of said chamber (64), said sleeve (72) serving as said exit orifice blocking means (68).

4. In a system (10) having a pressurized fuel source (14), a sump (50), and a main (16) and at least one secondary (18) receptor to which pressurized fluid is supplied from said source (14), the improvement comprising:

a body (46) having a bore (44) therein;

means (20, 20*a*, 66) fo delivering pressurized fluid from said source (41) to said bore (44);

a piston (42) having a first end (58) a second end (60) and a tunnel (56) having a restricted orifice (62) and extending from said first end (58) to said second end (60), said piston (42) being reciprocally mounted in said bore (44) and positionable in a first position blocking delivery of pressurized fluid from said bore (44) to said secondary receptor (18), in a second position allowing said delivery and in a third position allowing said delivery and passing a portion of said pressurized fluid to said sump (50);

a spring (54) in a spring chamber (64) defined by said body (46) and said second end (60) of said piston (42), said spring (54) being positioned to motivate said piston (42) towards said first position in said bore (44);

means (66) for moving said piston (42) to said second position in said bore (44) in response to a pressure in said main receptor (16) reaching an initiating value (A) and to said third position in response to said pressure in said main receptor (16) reaching a selected value (D) above said initiating value (A);

an exit orifice (65) communicating said spring chamber (64) with said sump (50); and means (68) for blocking said exit orifice (65) in response to movement of said piston (42) from said second position to said third position.

5. In a system (10) having a pressurized fluid source (14), a sump (50), and first and second receptors (16,18) for receiving pressurized fluid from the source (14), the improvement comprising:

a body (46) defining a bore (44), first and second inlets (20, 20*a*) and a first and second outlets (18,48) connected to the bore (44), the second inlet (20*a*) connected to the source (14), the first outlet (18) connected to the first receptor (18), the second outlet (48) connected to the sump (50);

filter means (38) for filtering the fluid received from the source (14) and delivering it to the first inlet (20);

a piston (42) mounted in the bore (44) and movable to first, second and third positions in response to fluid pressure in the first inlet (20), the first position blocking fluid communication between the first inlet (20) and the first outlet (18), the second position communicating the first inlet (20) to the first outlet (18), and the third position communicating the second inlet (20*a*) to the second outlet (48) and the sump (50); and means (52) for biasing the piston (42) toward the first position.

* * * * *